US006844854B2

(12) United States Patent
Johnson et al.

(10) Patent No.: US 6,844,854 B2
(45) Date of Patent: Jan. 18, 2005

(54) INTERFEROMETRIC ANTENNA ARRAY FOR WIRELESS DEVICES

(75) Inventors: James R. Johnson, Pleasant Hill, CA (US); Steven L. Myers, Parkland, FL (US)

(73) Assignee: Myers & Johnson, Inc., Pleasant Hill, CA (US)

( * ) Notice: Subject to any disclaimer, the term of this patent is extended or adjusted under 35 U.S.C. 154(b) by 92 days.

(21) Appl. No.: 10/117,777

(22) Filed: Apr. 5, 2002

(65) Prior Publication Data

US 2003/0189518 A1 Oct. 9, 2003

(51) Int. Cl.[7] ..... H01Q 1/24
(52) U.S. Cl. ..... 343/702; 343/853
(58) Field of Search ..... 343/702, 725, 343/727, 729, 893, 853; H01Q 1/24

(56) References Cited

U.S. PATENT DOCUMENTS

| | | | | |
|---|---|---|---|---|
| 5,623,338 A | | 4/1997 | Wickramasinghe et al. | 356/357 |
| 5,652,591 A | | 7/1997 | Liu et al. | 342/380 |
| 5,894,286 A | | 4/1999 | Morand et al. | 342/442 |
| 6,031,495 A | | 2/2000 | Simmons | |
| 6,111,416 A | | 8/2000 | Zhang et al. | 324/753 |
| 6,114,984 A | | 9/2000 | McNiff | 342/62 |
| 6,147,653 A | | 11/2000 | Wallace et al. | 343/702 |
| 6,147,656 A | | 11/2000 | Luh | 343/753 |
| 6,147,657 A | | 11/2000 | Hildebrand et al. | 343/844 |
| 6,147,658 A | | 11/2000 | Higashi et al. | 343/853 |
| 6,148,023 A | | 11/2000 | Pelin et al. | 375/206 |
| 6,148,195 A | | 11/2000 | Schuchman et al. | 455/424 |
| 6,175,334 B1 | * | 1/2001 | Vannatta et al. | 343/702 |
| 6,239,755 B1 | | 5/2001 | Klemens et al. | 343/702 |
| 6,242,917 B1 | | 6/2001 | Nistler et al. | 324/318 |
| 6,246,481 B1 | | 6/2001 | Hill | 356/487 |
| 6,275,188 B1 | | 8/2001 | Chen | 343/382 |
| 6,288,673 B1 | | 9/2001 | Dolmeta et al. | 342/374 |
| 6,469,671 B1 | * | 10/2002 | Pluymers et al. | 343/702 |
| 6,525,691 B2 | * | 2/2003 | Varadan et al. | 343/700 MS |
| 2002/0000937 A1 | * | 1/2002 | Kozakai | 343/700 MS |

FOREIGN PATENT DOCUMENTS

| | | |
|---|---|---|
| EP | 1 206 000 A2 | 11/2001 |
| JP | 11284424 | 1/2000 |
| WO | WO 9952177 | 3/1999 |
| WO | WO 0111716 A1 | 2/2001 |
| WO | WO 0156110 A1 | 8/2001 |
| WO | WO 0229925 A1 | 4/2002 |

OTHER PUBLICATIONS

International Search Report issued for corresponding PCT application PCT/US00/09974.

* cited by examiner

*Primary Examiner*—Hoanganh Le
(74) *Attorney, Agent, or Firm*—Choate, Hall & Stewart

(57) ABSTRACT

An interferometric antenna array for use with a wireless communications device in reducing electromagnetic energy in a region proximate to the antenna array. The antenna array comprises two or more radiating elements coupled through circuitry to the wireless communications device. The circuitry operates to appropriately divide a signal from the communications device into a plurality of signals and to phase-shift the plurality of signals such that the electromagnetic wave pattern formed proximate to the antenna array by the two or more radiating elements, which are fed by the phase-shifted plurality od signals, includes a spatial null. The spatial null is located at a region where sensitive electronic equipment, or some portion of a user of the communications device is also located.

37 Claims, 7 Drawing Sheets

INTERFEROMETRIC ANTENNA ARRAY FOR WIRELESS DEVICES

FIELD OF THE INVENTION

The present invention relates generally to an apparatus and method for controlling electromagnetic wave propagation from wireless communications devices for reducing the amount of undesired energy to a user's head or body, or to sensitive electronics that might be proximate to the radiating antennas. More specifically, the present invention uses an interferometric array of two or more antennas to nullify any undesired radiation at selected areas proximate to the interferometric array, which additionally results in far field nulls.

BACKGROUND OF THE INVENTION

Portable wireless communications devices have received scrutiny regarding their safety with respect to the potential danger associated with the transmission of the signals from such apparatus. When a user of a wireless communication device, such as a cellular telephone, talks on the device, he holds the telephone up his head so that the earpiece is in contact with his ear. In close proximity is the antenna, which usually extends from the top surface of the telephone and which transmits electromagnetic radiation. Typically, the antenna of cellular phones and other wireless communications technologies (PCS, G3 or Blue Tooth) emit radiation in the UHF and/or microwave frequency ranges.

The effect of this electromagnetic radiation on the tissues of the user is being studied. Investigations are underway attempting to ascertain whether links exist between this radiation and maladies such as cancer, weakening of the blood-brain barrier, and high blood pressure. (see, *Cellular Phones: Why the Health Risk Can't be Dismissed*, Microwave News, January/February 1993; *Digital Mobile Phone Radiation Causes Rise in Blood Pressure*, Microwave News, July/August 1998; *Questions and Answers About Electric and Magnetic Fields Associated with the Use of Electric Power*, National Institute of Environmental Health Sciences, U.S. Department of Energy, November 1994.) As public awareness of the potential health risk has grown, so too has the demand for reducing the amount of radiation directed toward and absorbed by the user. Additionally, undesired electromagnetic radiation has also been found to cause interference in certain sensitive electronic equipment located nearby. FIG. 3 shows a typical configuration for a cellular phone 1, wherein a telescoping or fixed antenna element 5 is disposed externally from the top surface of the phone. The figure also shows lines 3 representing electromagnetic radiation that are emitted from such an antenna. Often these types of antennas result in an asymmetric radiation pattern because the shape and dimensions of the ground plane of a printed wire board (PWB) (incorporating the phone's circuitry) that is used as a counterpoise for the antenna element results in an unequal current distribution in the antenna element and in the ground plane.

In general, electromagnetic wave propagation has been controlled in commercial and military applications as a means to reduce signal jamming at certain locations, to locate targets, or to enhance gain and directionality in desired areas. Past approaches to radiation reduction have utilized several art forms, including the use of shields made by special materials, or other means such as the use of multiple radiating or parasitic elements within a symmetrical or asymmetrical dipole antenna configuration. Typically, the size and distance between radiating elements, along with other variables, offers a means to create the desired wave pattern. These approaches are unconcerned with, and produce inconsistent results for, electromagnetic wave propagation near the user's antenna array and head.

It is known in the art that by providing shielding, some undesired electromagnetic radiation may be suppressed. This approach is taken by Luxon, et al., in U.S. Pat. No. 5,666,125, and Humbert, et al., in U.S. Pat. No. 5,124,889.

Others have attempted to control of electromagnetic wave propagation by employing symmetrical or asymmetrical antenna configurations (Uda-Yagi approach). U.S. Pat. No. 6,147,653 to Wallace, et al., describes a balanced dipole antenna for a mobile phone comprised of a radiator element and counterpoise electrically isolated from the PWB of the mobile phone. As controlling directivity in the far-field, rather than reducting electromagnetic energy near the antenna arrays was the goal of those inventors, the antenna elements are geometrically arranged in such a manner as to create a uniform gain in the azimuth. U.S. Pat. No. 6,239,765 to Johnson, et al., describes utilizing an asymmetric dipole antenna assembly for communications devices operating at predetermined wavelengths and having a transceiver circuit, conductor trace elements plated onto a dielectric using common printed circuit board manufacturing technology with the traces having a first end, a one-quarter wavelength electrical length and a second dipole half. Some communications engineers, however, are skeptical of using directional configurations in the industry. See "*Handset Antennas and Humans*", IEEE Proceedings, January 1995.

A third approach to controlling electromagnetic wave propagation has been to employ an array wherein signals generated are phased (in or out) or the signals are cross-polarized. For example, U.S. Pat. No. 6,292,135, to Takatori, et al., describes an adaptive array antenna designed to identify and strengthen or weaken desired signal strengths in poor multipath environments. And U.S. Pat. No. 6,275,199 to Chen describes a nulling direct radiating array and a plurality of auxiliary arrays symmetrically disposed about the main array. This system includes a nulling processor, an adaptive weighting network and weight generator within the nulling processor, and is related to a military application of blocking jamming signals again originating far from the passive receiving antenna array system, rather than reducing radiation emitted from a wireless device.

Accordingly, a need exists for an antenna array for use with a wireless communications device, wherein the antenna array is configured and excited in a manner that will reduce or eliminate undesired electromagnetic radiation near the antenna array.

SUMMARY OF THE INVENTION

The present invention provides an interferometric antenna array as a simple, unique, natural and absolute means for controlling energy around a desired location such as a user's head or body or as a means toward preventing undesirable energy from negatively affecting operation of sensitive equipment that is found to be near the radiating elements. For example, assisted listening devices (hearing aids) are sensitive to energies typically emitted from wireless communications devices, but the present invention provides a solution.

An additional use environment for the present invention is in the field of bioelectromagnetics. Implantable transmitters may be used to collect, receive and transmit data to and from a user. Such transmission may be fully automated, or require the conscious cooperation of the user. The present invention provides a highly directional antenna which may be used in implantable wireless transmitters that are implantable into a subject's body, enabling transmission to a desired target while reducing electromagnetc propagation in undesirable directions (e.g., further into the user's body.)

In one embodiment, the present invention provides two radiating antenna elements coupled to signal balancing and phase shifting means between a common signal source of the wireless communications device and the radiating antenna elements. The signals emitted from the radiating elements are substantially equal in magnitude but out of phase by 360°/N, where N represents the number of antenna elements (i.e. two in this embodiment.) The antenna elements are arranged side-by-side and emit radiation that create a symmetric wave pattern, including a null along and near an axis of symmetry between the antenna elements. The antenna elements are positioned such that a user of the communications device will be positioned along or near this axis of symmetry when using the communications device.

In other embodiments, the present invention provides interferometric antenna arrays of wireless communications devices configured with three or more radiating elements which emit electromagnetic waves in such a pattern as to create a spatial null near the antenna array and the wireless communications device user's head and body or the sensitive electronic equipment for which protection is desired.

DETAILED DESCRIPTION OF CERTAIN EMBODIMENTS OF THE INVENTION

Referring now to the accompanying drawing, wherein like numerals depict like parts throughout, embodiments of the present invention are illustrated in FIGS. 1–7. Although certain preferred embodiments are depicted in the context of cellular phones, the use of an interferometric antenna array in accordance with the present invention in reducing or eliminating unwanted radiation will be readily appreciated by an artisan to be applicable to wireless communications devices operating in multiple frequency ranges, such as cellular telephones (824–890 MHz and 860–980 MHz), PCS devices (1710–1880 MHz, 1750–1870 MHz, and 1850–1990 MHz), cordless telephones (902–928 MHz), military and Satcom communications (225–400 MHz), or BLUETOOTH™ devices (2.4–2.5 GHz), and complying with protocols such as 802.11, CDMA and CDPD.

Figure 1:
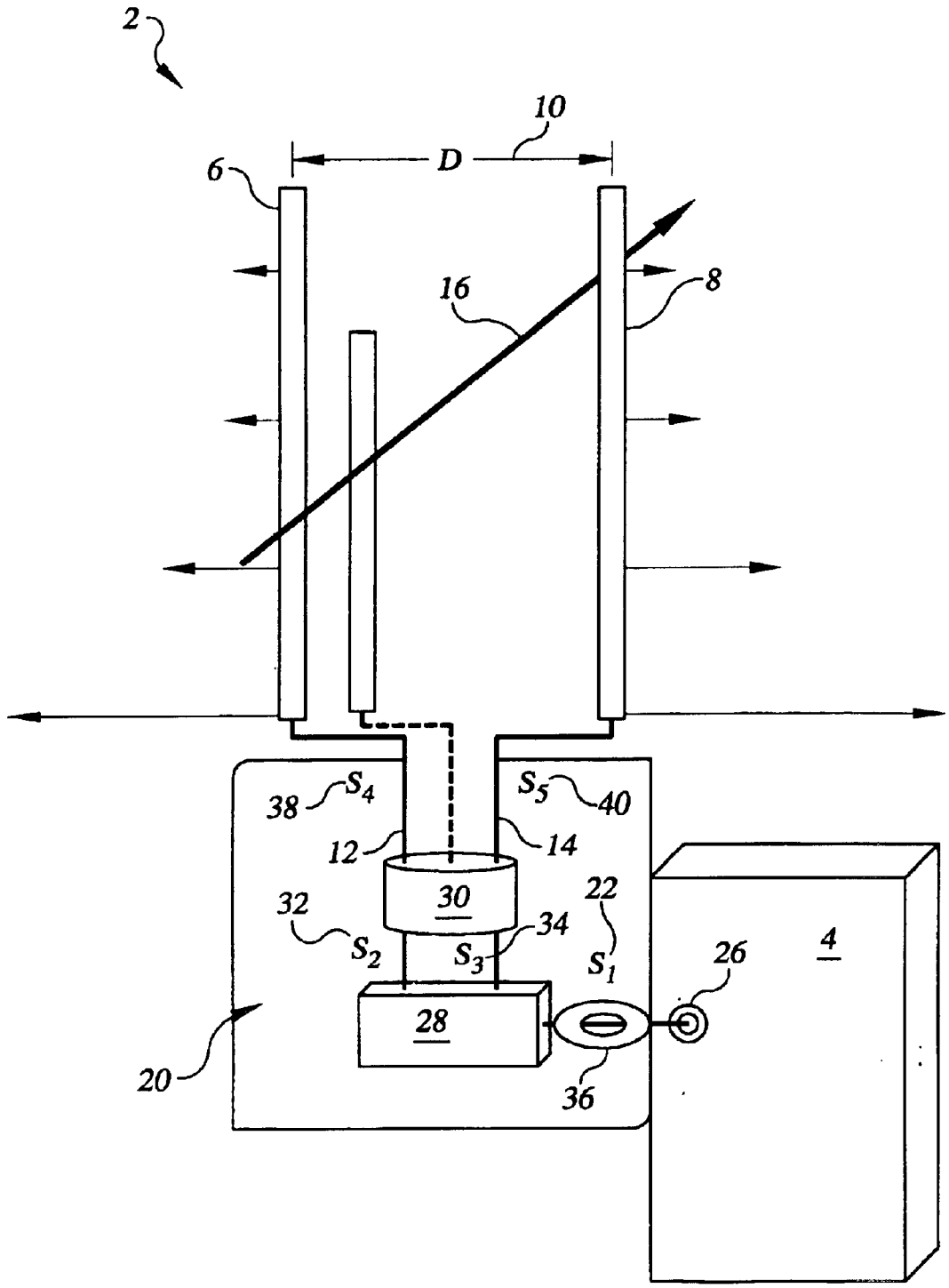
FIG. 1 is a block diagram of one embodiment of an antenna array in accordance with the present invention.
Figure 2:
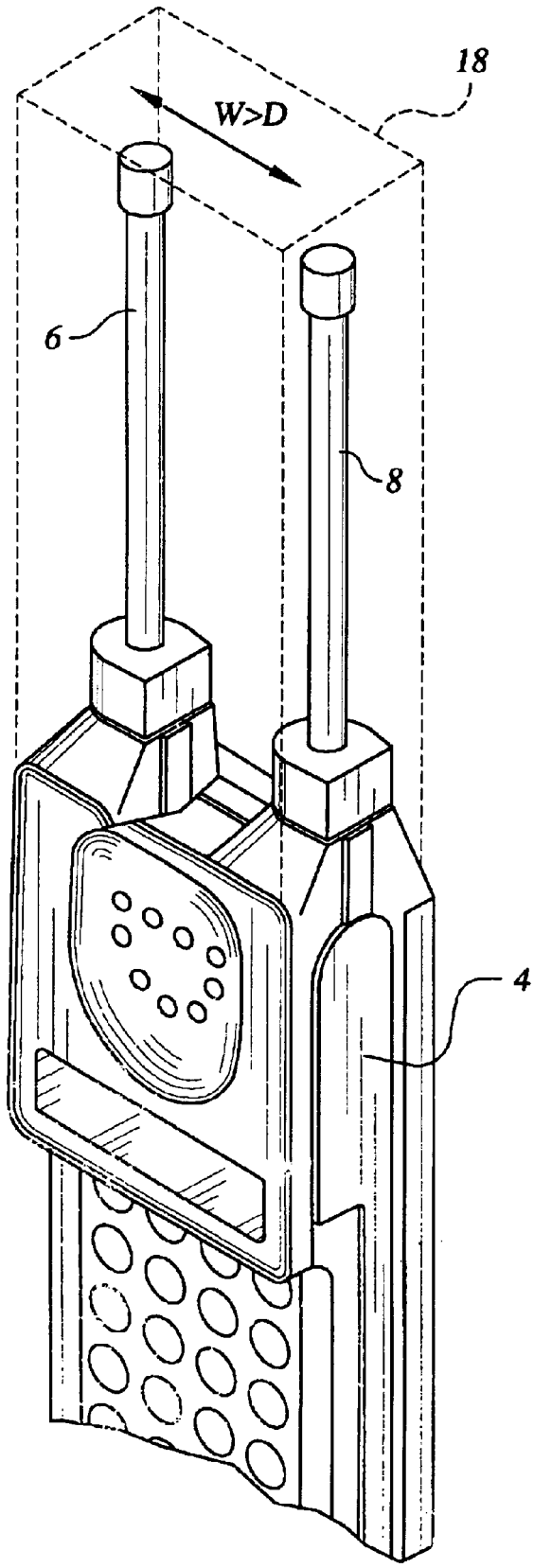
FIG. 2 is an illustration of a cellular telephone equipped with two radiating elements.
Figure 3:
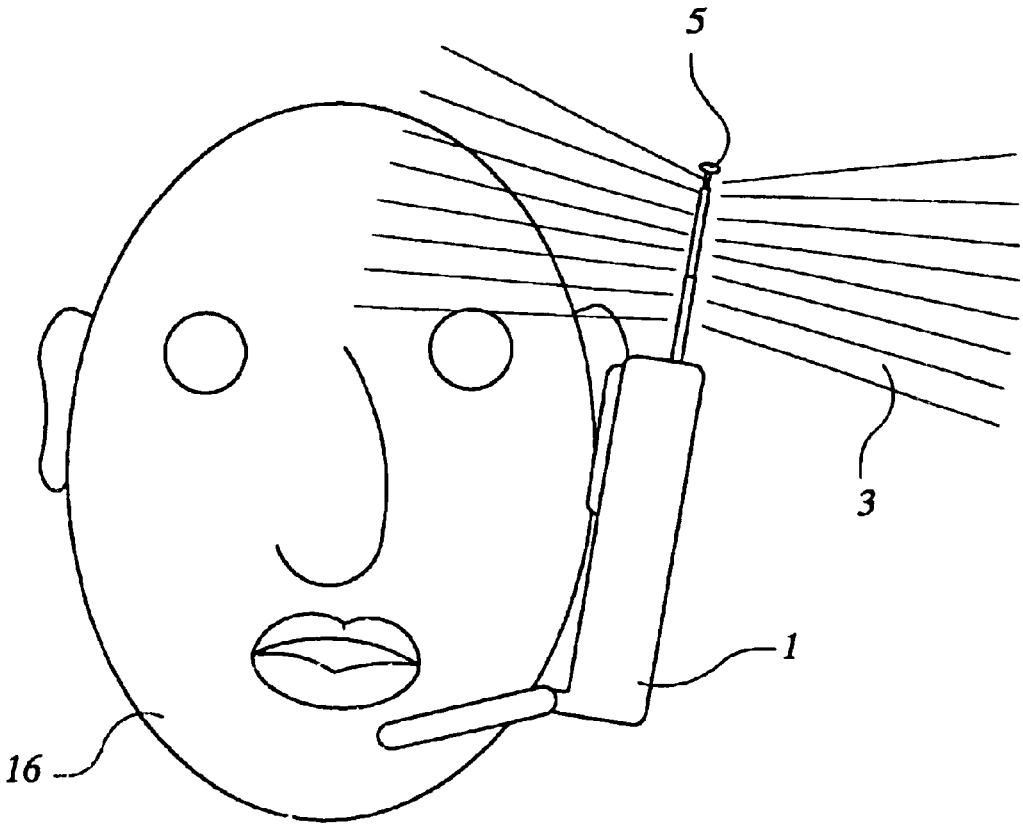
FIG.3 PRIOR ART
FIG. 3 is an illustration of a user of a prior art wireless communication device employing a single radiating element generating an omnidirectional electromagnetic wave pattern.

In one embodiment illustrated in FIG. 1, the present invention provides a two element antenna array 2 adapted for use in a wireless communications device 4. The array 2 is designed to emit a symmetrical electromagnetic pattern of RF energy and place a spatial null in the space occupied by the head and body of a user of the wireless communications device 4, which will most likely also be the space for which the greatest concern for induced electromagnetic interference will exist. Two radiating dipole elements 6, 8 are adapted for use with the wireless device 4 and are arranged side-by-side and separated from each other by a judiciously selected distance D 10 shorter than one-half the wavelength of the radiation being emitted. Preferably, the distance D 10 between the radiating elements will be one-third of this wavelength or shorter. Feeding the two radiating elements 6, 8 are two signals $S_4$ 12 and $S_5$ 14 of opposite polarity (i.e., having a 180° phase difference) such as to create this void of radiated RF energy where no energy is desired.

Figure 4:
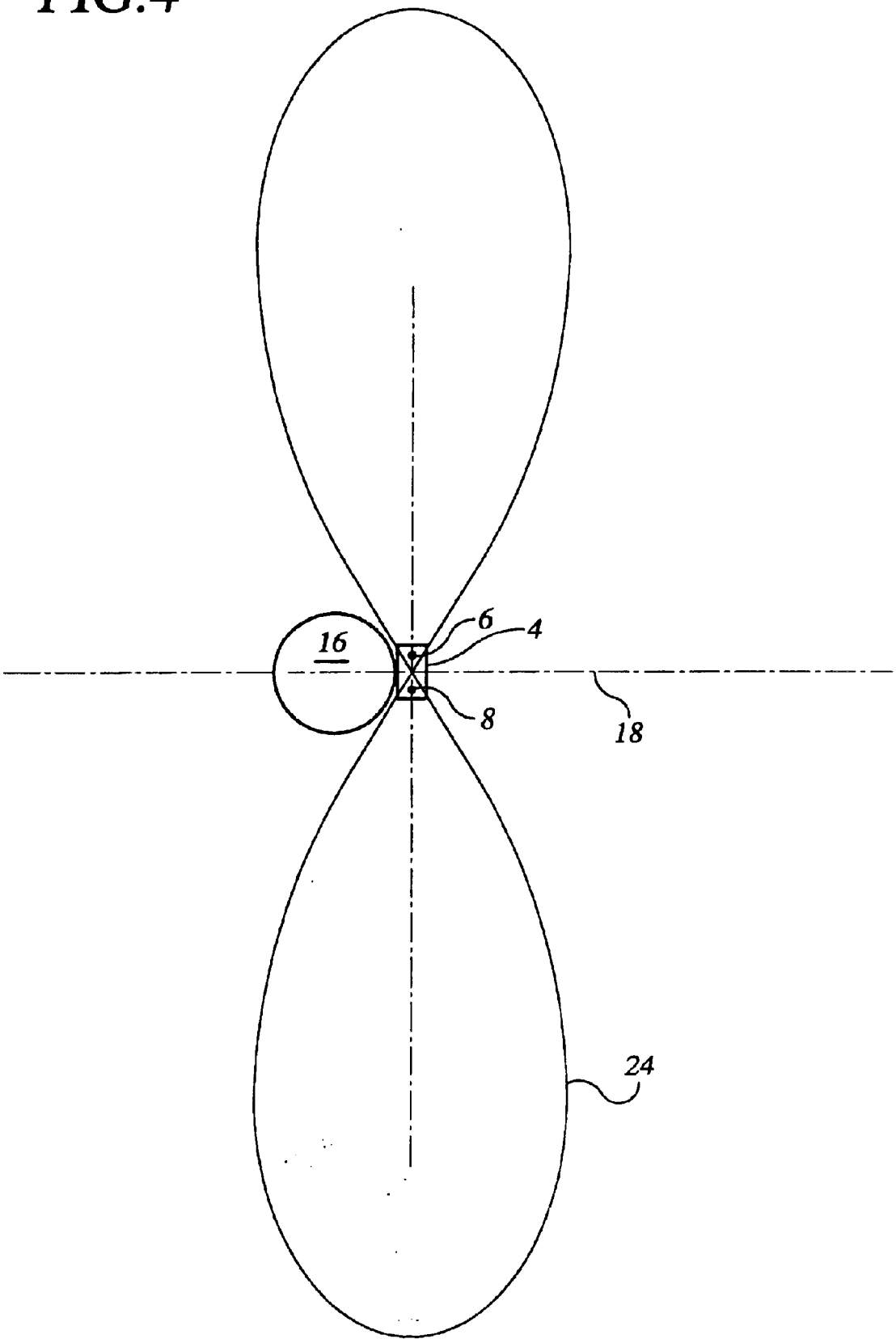
FIG. 4 is an illustration of a wave pattern produced by a wireless communications device employing a two-element antenna array configured in accordance with the present invention.

The angular placement and distance D 10 between the radiating elements 6, 8 are important parameters in defining a vector 16 distance from points along the radiating elements at which electromagnetic waves radiated from the radiating elements combine to form fringe patterns and to cancel out in the desired areas. The distance D 10 will be constrained primarily by the width of the wireless device 4 (which in the case of the cellular phone shown in FIG. 2 will be approximately 3 inches) in or on which the radiating elements 6, 8 are located. The radiating elements may either be fixed or telescoping, but are configured in a way such that the distance D 10 between the elements remains constant, and that the user 16 of the wireless device 4 is on or near the axis of symmetry 18, as illustrated in FIG. 4. Along this axis, electromagnetic waves from each of the radiating elements travel approximately the same distance and combine to cancel each other's energy out. In an area near the axis of symmetry, energy is reduced as desired for safety, health or prevention of electromagnetic interference. This configuration and excitation of array elements may have an incidental effect at greater distances from the antenna array of enhancing gain and signal strength in particular symmetrical directions. But it should be noted that the user of the wireless communications device typically cooperatively reorients himself and the wireless communications device to maximize signal reception if the strength of the signal being received is inadequate.

In certain embodiments, the radiating elements 6, 8 have a symmetric geometry, and in a preferred embodiment comprise ordinary dipole antennas of any length, but having an overall effective length that is substantially ½ of the wave length of the signal being transmitted by the wireless communications device. One skilled in the art will appreciate that other antenna element lengths may also be used, for example, ¼ of the wavelength of the signal being transmitted. Each element is fitted to the desired form (stamped metal, printed circuit board, flex circuitry, wires or other means of creating a circuit.) The elements 6, 8 may be fixedly embedded within or externally placed on or around the wireless device 4 as desired and/or legal, either configuration offering the benefits described above. The elements may be housed in an envelope 18 designed for ergonomic, safe and economic use and is constructed of ABS or other moldable or stampable materials.

FIG. 1 illustrates a block diagram of a two-element embodiment of an antenna array system incorporating the teachings of the present invention. As depicted, the two radiating elements 6, 8 are coupled to a circuit 20 responsible for producing wave and anti-wave signals of equal current from a signal $S_1$ 22 generated by the wireless device 4. The circuit 20 and radiating elements 6, 8 themselves may be entirely printed on a PWB. In a preferred embodiment, the radiating elements are electrically isolated from the ground plane of the PWB, however use of the PWB ground plane is permitted. The circuit impedance is 50 ohms to match the wireless communications device. In the circuit shown, a phase shift effected by the circuit and transmission paths results in the radiating elements being excited by signals $S_4$ 12 and $S_5$ 14 having equal amplitudes but a phase difference of 180 relative to one another. Where the energy waves emitted from the elements overlap, the resulting wave patterns generate a null, a portion of which is coincident with the position of the user when communicating on the wireless device. The configuration results in a "figure 8" pattern 24 with forward and rear lobes providing additional gain in the longitudinal axis as depicted in FIG. 4. The trace patterns and circuitry, when manufactured under strict symmetrical requirements, result in self-balancing and self-nullifying interferometric performance. The system additionally creates wave pattern nulls far from the radiating antenna elements. The arrangement of the two radiating elements relative to the circuit is not critical provided that the radiating elements are arranged so as to create the null in the lateral axis 18 where the user will be positioned and that the proper relative phase relationship is maintained between the elements. A balun may optionally be employed to accommodate a design resulting in an unbalanced system To generate the spatial null in the two-element configuration of FIG. 1, signal $S_1$ 22 is processed by the circuit 20. Signal $S_1$ 22 may be received from a common feed point 26 of the wireless device 4, or may instead be provided through an optional interface 36 in the circuit path from the feed point 26. The interface 36 allows signals from an external devices or loads to be substituted for signals received from the wireless device and to be transmitted by the interferometric antenna array. The circuit 20 of this embodiment may be comprised of a radio frequency power splitter 28 and a phase shifter 30 placed in the path of one or both of the split signals $S_2$ 32 and $S_3$ 34. Signal $S_1$ 22 may be split by the power splitter 28 into two signals $S_2$ 32 and $S_3$ 34 with equal amplitude and frequency. Then, signals $S_2$ 32 and $S_3$ 34 may be transmitted through phase shifter means 30 to their respective radiating elements 4, 8. It is known in the art that dissimilar length transmission paths can provide a phase shifting means between two signals initially in phase. The phase shifting means 30 employed in this first embodiment comprises transmission pathways of different lengths, which are appropriately selected to create a phase difference between the signals $S_4$ 38 and $S_5$ 40 of approximately 180. As the electromagnetic waves generated propagate from the radiating elements, they cancel each other out in an area proximate to the radiating elements due to this phase difference, thereby forming the spatial null in and near to the lateral axis 18, as depicted in FIG. 4. The spatial null reflects an absence of the electromagnetic radiation which is of concern to wireless device users and health physicists alike. As also shown, this antenna array configuration incidentally creates a symmetrical wave pattern with increased gain along the longitudinal axis.

Figure 5:
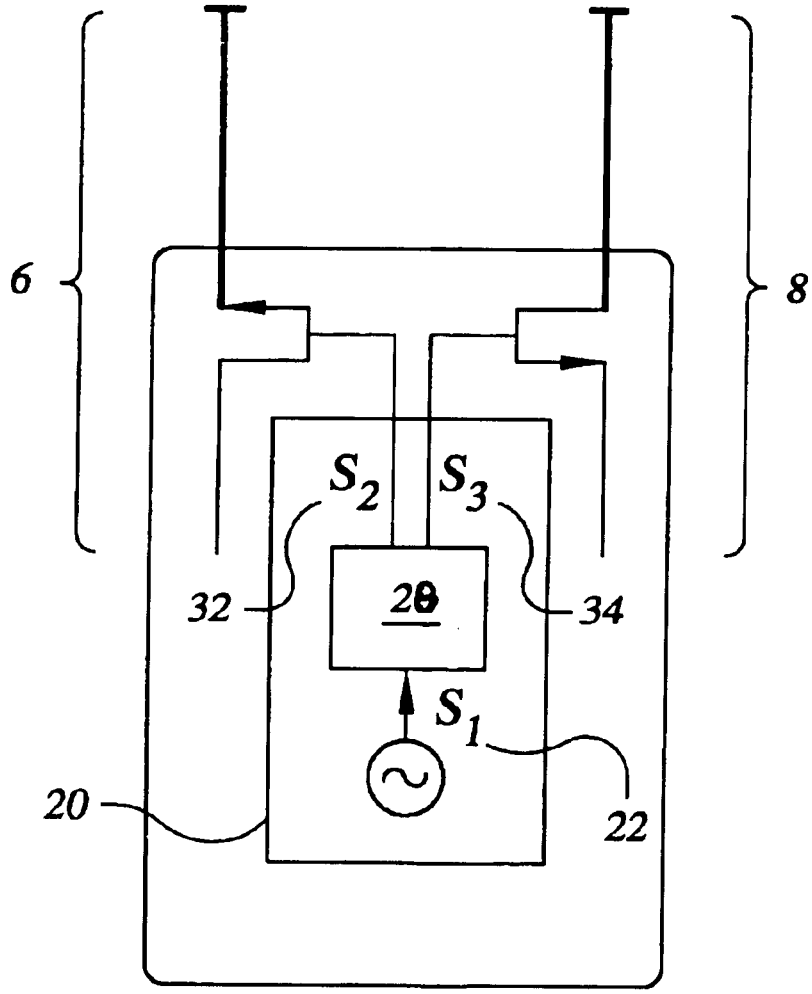
FIG. 5 is a block diagram illustrating an alternative means for creating a 180 degree phase difference between radiated energy waves.

Other means for attaining a phase difference between two signals are known to artisans and are considered to be within the scope of the present invention. For instance, in another embodiment of the IAA circuit 20, as depicted in FIG. 5, the relative phase shifting is accomplished by feeding the power-split signals $S_2$ 32 and $S_3$ 34 with substantially similar phase characteristics to opposite ends (front feed or end feed) of their associated dipole antenna elements 6, 8. This achieves the same spatial nulling effect as the phase shifting means described above.

Figure 6:
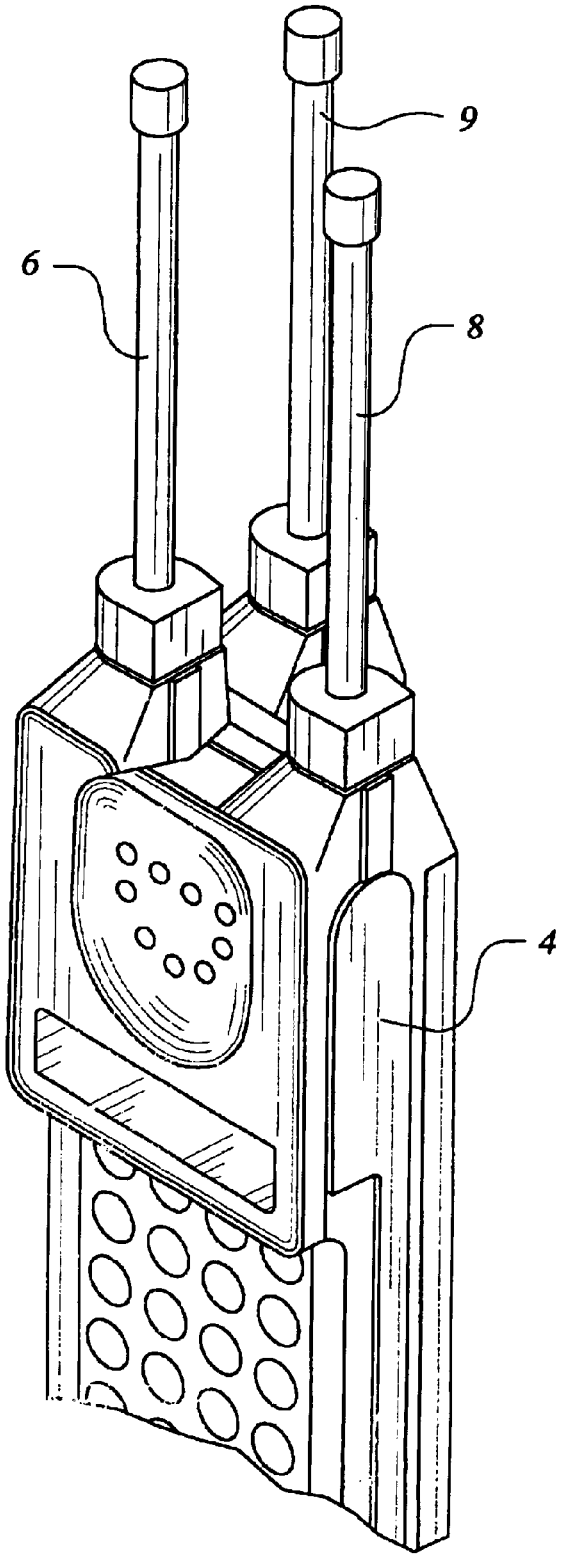
FIG. 6 is an illustration of a cellular telephone equipped with three radiating elements.
Figure 7:
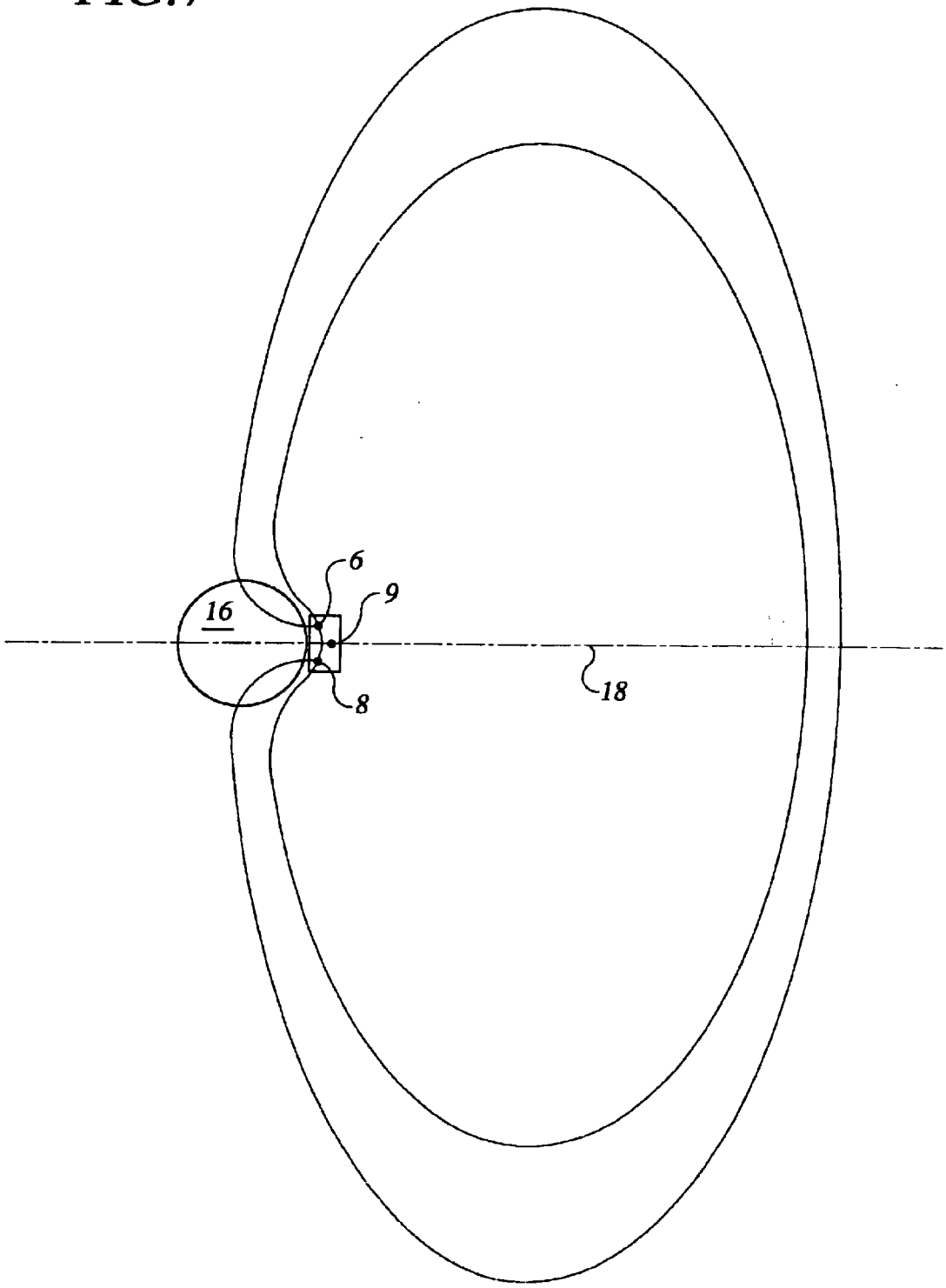
FIG. 7 is an illustration of a wave pattern produced by a wireless communications device employing a three-element antenna array configured in accordance with the present invention.

In another embodiment, the present invention provides interferometric antenna arrays configured with more than two radiating elements. For example, a three-element 6,8,9 array is depicted in FIG. 6. Configurations having more than two radiating elements results, in some cases, in the loss of an ominidirectional spatial null along the entire lateral axis 18, but in the region of interest (the user's head and body) reduced electromagnetic radiation is still achievable. The general cartoidal shape of an achievable wave pattern using a three-element configuration is illustrated in FIG. 7. In this configuration, a third radiating element 9 is place equidistant from two radiating elements 6,8 as previously described. To obtain this wave pattern, substantially no phase difference should exist among the signals exciting the radiating elements 6,8,9, however the power delivered to the third radiating element 9 should be nearly equal to twice that delivered to each of the two radiating elements 6,8.

In yet another embodiment, the present invention provides an N-element interferometric antenna array for use with a wireless communications device resulting in reduced undesired electromagnetic energy proximate to the antenna array. The complexity and expense of constructing arrays with a high number of radiating elements may increase significantly without necessarily achieving superior electromagnetic energy reduction over arrays with lower numbers of radiating elements. Generally speaking, a greater number of radiating elements results in a greater number of propagation lobes and spatial null areas, though narrower. Each of the N radiating elements may be fed through N associated phase shifting means. As one example, a branch circuit or other configuration (and possibly an amplifier) may be used to divide the common feed signal from the wireless communications device into a multiplicity of equivalent signals each available to one of the N antenna elements.

In determining the parameters of the excitation signals required to achieve the desired spatial null an in N-element array, an antenna array designer should be guided by the following formula:

$$\vec{E}(\vec{r},t) = \mathrm{Re}\left\{\sum_{n=1}^{N} A_n E_o e^{i\left(wt-k\left|\vec{r}-\vec{r}_{1_n}\right|+\Phi_n\right)}\hat{1}_n\right\}$$

wherein:

N is the number of elements in the array;

$\vec{E}(\vec{r},t)$ may be expressed in a cartesian, polar, or any other coordinate system;

$E_o$ is a base electric field value;

$A_n$ is a relative amplitude constant, which could be adjusted in real-time by a microprocessor for optimum operation, but in the example given below is considered to be fixed;

w is the radian temporal frequency;

t denotes time;

k is the propagation constant in free space, given by 2/, where represents the wavelength of the transmitted radiation;

$\vec{r}$ represents a position vector of a point in space;

$\vec{r}_{1_n}$ represents an equivalent position vector of the individual element n forming the interferometric array;

$|\vec{r}-\vec{r}_{1_n}|$ represents the equivalent distance between the individual element n and the point in space being analyzed, for example, $|\vec{r}-\vec{r}_{1_n}|=\sqrt{(x-x_{1+\text{dist}})^2+(y-y_{1+\text{dist}})^2+(z-z_{1+\text{dist}})^2}$, where $x_{1_n}$, $y_{1_n}$, $z_{1_n}$ are the equivalent coordinates of the array element n;

$\Phi_n$ is the fixed (or microprocessor-adjusted) phase of the signal being fed into array element n;

$\hat{1}_n$ denotes a unit vector in the direction of array element n's transmitted electric field;

Re{} denotes the real operator;

and where $A_n$ and $\Phi_n$ are chosen such that, at the location where the null is desired (e.g., near the user's head), denoted here as $\vec{r}=\vec{r}_o$, the aggregate field vanishes, $$\vec{E}(\vec{r},t)=\sum_{n=1}^{N}A_nE_oe^{i(\omega t-k|\vec{r}-\vec{r}_{1_n}|+\Phi_n)}\hat{1}_n=0.$$

For example, in the convenient, 2-element embodiment, $A_1=A_2=1$ $\Phi_1$ and $\Phi_2$ are fed 180 out of phase (±90, or 0 and 180), and preferably $\hat{1}_1=\hat{1}_2$.

Other embodiments of the invention will be apparent to those skilled in the art from a consideration of the specification or practice of the invention disclosed herein. For example, as mentioned above, the interferometric antenna array can be used in conjunction with an implantable wireless transmitter. It is intended that the specification and examples be considered as exemplary only, with the true scope and spirit of the invention being indicated by the following claims.

What is claimed is:

1. An interferometric antenna array for use with a wireless communications device in reducing electromagnetic energy in a region proximate to the antenna array, comprising:

two radiating elements formed of conducting material and adapted for use with a wireless communications device and arranged side-by-side separated by a distance;

a power splitting means coupled to the wireless communications device for dividing a signal from a feed of the wireless communications device into two split signals;

a phase-shifting means coupled to the two radiating elements and to the power splitting means for creating a phase difference between the two split signals, the phase difference created by the phase-shifting means selected to form a wave pattern having a spatial null proximate to the antenna array;

wherein each of the two radiating elements is fed by one of the two phase-shifted split signals.

2. The interferometric antenna array of claim 1, wherein the two radiating elements further comprise dipole antennas.

3. The interferometric antenna array of claim 1, wherein the two split signals have approximately equal magnitudes.

4. The interferometric antenna array of claim 1, wherein the phase difference is approximately 180 degrees.

5. The interferometric antenna array of claim 1, wherein the spatial null further comprises a symmetric null along and proximate to an axis of symmetry between the radiating elements.

6. The interferometric antenna array of claim 1, wherein the radiating elements are separated by a distance less than one half of the free space wavelength of a signal to be emitted from the two radiating elements.

7. The interferometric antenna array of claim 1, wherein the radiating elements are separated by a distance less than one third of the free space wavelength of the signal to be emitted from the two radiating elements.

8. The interferometric antenna array of claim 1, wherein the wireless communications device comprises a portable wireless communications device.

9. The interferometric antenna array of claim 1, wherein a frequency range of the signal to be emitted is selected from the group consisting of 824–890 MHz and 860–980 MHz corresponding to cellular phone frequencies, 1710–1880 MHz and 1850–1990 MHz corresponding to PCS frequencies, 902–928 MHz, 2.4 to 2.485 GHz and ISM frequencies corresponding to cordless telephone, and wireless LANs, and 225–400 MHz corresponding to military and Satcon frequencies.

10. The interferometric antenna array of claim 1, wherein the phase-shifting means comprises dissimilar transmission path lengths from the power splitter to the radiating elements.

11. The interferometric antenna array of claim 1, wherein the phase-shifting means comprises similar transmission path lengths incorporating connection reversal at either the radiating elements or at the power splitter.

12. The interferometric antenna array of claim 1 wherein the elements are fed off-center.

13. The interferometric antenna array of claim 1 wherein the elements are fed at the extreme ends, giving the antenna the appearance of a loop.

14. The interferometric antenna array of claim 1 wherein the elements are fed off-center, symmetrically about the center.

15. The interferometric antenna array of claim 1 wherein the antenna operates on more than one frequency band at a time.

16. The interferometric antenna array of claim 1 wherein the elements are fed in a series configuration.

17. The interferometric antenna array of claim 1 wherein the elements are fed in a parallel configuration.

18. An interferometric antenna array for use with a wireless communications device in reducing electromagnetic energy emitted proximate to the antenna array, comprising:

three radiating elements formed of conducting material adapted for use with a wireless communications device and separated by distance from each other;

a power splitting means coupled to the wireless communications device or dividing a signal from a feed of the wireless communications device into three split signals;

a phase shifting means coupled to the three radiating elements and to the power splitting means for creating phase differences among the three split signals, the phase differences among the three split signals created by the phase shifting means selected to form a wave pattern having a spatial null proximate to the antenna array;

wherein each of the three radiating elements is fed by one of the three phase-shifted split signals.

19. The interferometric antenna array of claim 18, wherein three radiating elements are configured with a first two of the three radiating elements side-by-side and the third radiating element positioned triangularly from the first two.

20. The interferometric antenna array of claim 18, wherein each of the radiating elements is separated by a distance less than one half of the free space wavelength of a signal to be emitted from the three radiating elements.

21. The interferometric antenna array of claim 18, wherein one of the three split signals is approximately twice the power of the other two split signals.

22. The interferometric antenna array of claim 18, wherein the three radiating elements further comprise dipole antennas.

23. The interferometric antenna array of claim 18, wherein the spatial null further comprises a null on a side of the wireless communications device opposite to the third radiating element.

24. The interferometric antenna array of claim 18, wherein the three radiating elements are separated by a distance less than one third of the free spacewavelength of the signal to be emitted from the three radiating elements.

25. The interferometric antenna array of claim 18, wherein the wireless communications device comprises a portable wireless communications device.

26. The interferometric antenna array of claim 18, wherein a frequency range of the signal to be emitted is selected from the group consisting of 824–890 MHz and 860–980 MHz corresponding to cellular phone frequencies, 1710–1880 MHz and 1850–1990 MHz corresponding to PCS frequencies, 902–928 MHz, 2.4 to 2.485 GHz and ISM frequencies corresponding to cordless telephone, and wireless LANs, and 225–400 MHz corresponding to military and Satcon frequencies.

27. An interferometric antenna array for use with a wireless communications device for reducing electromagnetic energy emitted proximate to the antenna array, comprising:

N number of radiating elements formed from conducting material adapted for use with a wireless communications device and separated by a distance;

a power splitting means coupled to the wireless communications device or dividing a signal from a feed of the wireless communication device into N split signals;

a phase-shifting means coupled to the N radiating elements and to the power splitting means for creating a phase difference among the N split signals, the phase differences among the N split signals created by the phase shifting means selected to form a wave pattern having a spatial null proximate to the antenna array;

wherein each of the N radiating elements is fed by one of the N phase-shifted split signals.

28. The interferometric antenna array of claim 27, wherein the N radiating elements are each separated from the nearest radiating elements by a distance of less than one half of the free space wavelength of a signal to be emitted from the N radiating elements.

29. The interferometric antenna array of claim 27, wherein the radiating elements further comprise dipole antennas.

30. The interferometric antenna array of claim 27, wherein the spatial null is located at a region where a user of the wireless communications device will position his head.

31. The interferometric antenna array of claim 27, wherein each of the N radiating elements are separated by a distance less than one third of the free space wavelength of the signal to be emitted from antenna array.

32. The interferometric antenna array of claim 27, wherein the wireless communications device comprises a portable wireless communications device.

33. The interferometric antenna array of claim 27, wherein a frequency range of the signal to be emitted is selected from the group consisting of 824–890 MHz and 860–980 MHz corresponding to cellular phone frequencies, 1710–1880 MHz and 1850–1990 MHz corresponding to PCS frequencies, 902–928 MHz, 2.4 to 2.485 GHz and ISM frequencies corresponding to cordless telephone, and wireless LANs, and 225–400 MHz corresponding to military and Satcon frequencies.

34. The interferometric antenna array of claims 1, 18 or 27, wherein the wireless communications device is a transmitter affixed to a user's body.

35. The interferometric antenna array of claim 34, wherein the antenna array is affixed to the user's body.

36. The interferometric antenna array of claims 1, 18 or 27, wherein the wireless communications device is a transmitter implanted within a user's body.

37. The interferometric antenna array of claim 36, wherein the antenna array is implanted within the user's body.

* * * * *